US005307967A

United States Patent [19]

Seals

[11] Patent Number: 5,307,967

[45] Date of Patent: May 3, 1994

[54] ARTICLE CARRIER

[76] Inventor: Michael L. Seals, 707 E. Brooks, Chandler, Ariz. 85225

[21] Appl. No.: 805,114

[22] Filed: Dec. 10, 1991

[51] Int. Cl.[5] ..... A45F 3/14

[52] U.S. Cl. ..... 224/257; 224/258; 224/259; 224/151

[58] Field of Search ..... 224/259, 151, 202, 204, 224/205, 208, 250, 257, 258

[56] References Cited

U.S. PATENT DOCUMENTS

| | | | |
|---|---|---|---|
| 824,514 | 6/1906 | Stine | 224/204 |
| 861,850 | 7/1907 | Hill | 224/204 |
| 2,441,115 | 5/1948 | Lambert | 224/259 |
| 3,526,347 | 9/1970 | Kuban | 224/259 |
| 3,884,403 | 5/1975 | Brewer | 224/204 |
| 4,058,242 | 11/1977 | Brewer | 224/204 |
| 4,168,022 | 9/1979 | Brewer | 224/257 |
| 4,461,411 | 7/1984 | Harrow | 224/208 |
| 4,898,311 | 2/1990 | Boyer | 224/257 |
| 4,930,695 | 6/1990 | Thompson et al. | 224/257 |
| 5,016,797 | 5/1991 | Rowledge | 224/257 |

*Primary Examiner*—Allan N. Shoap
*Assistant Examiner*—Vanessa Caretto
*Attorney, Agent, or Firm*—Tod R. Nissle

[57] ABSTRACT

An article carrier. The carrier comprises an inverted U-shaped sling strap carried over a shoulder of a user. The carrier can be configured into a strip system which extends around the torso and over both shoulders of the user.

1 Claim, 6 Drawing Sheets

FIG. 8
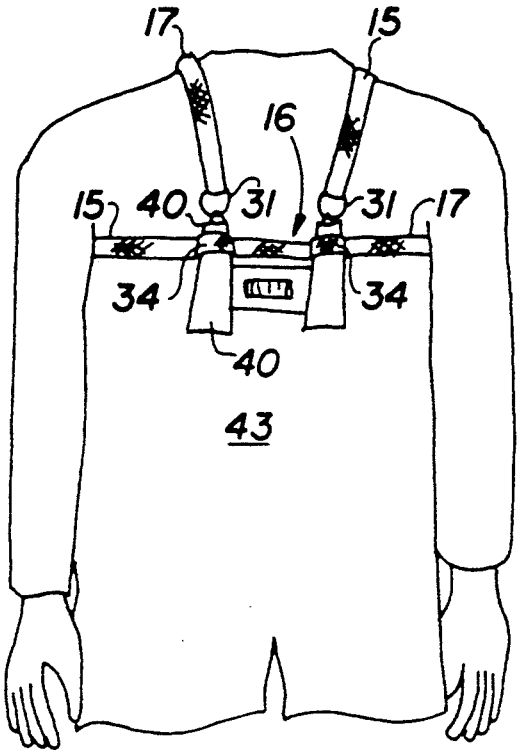
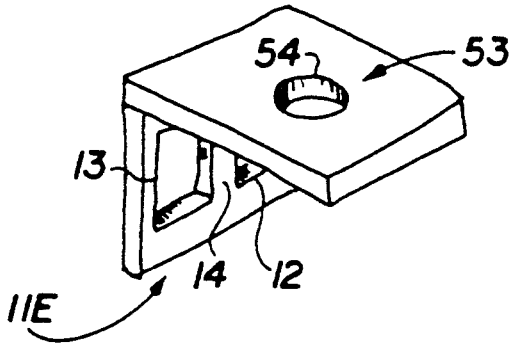
FIG. 10

ARTICLE CARRIER

This invention relates to a strap system for carrying articles on the person.

More particularly, the invention relates to an article carrier which can be readily adjusted for use on a child or an adult, which can be adjusted for use in the form of an inverted U-shaped sling strap that extends over only one shoulder of a user, which can be adjusted for use in a form in which the carrier extends over and distributes the weight of an article between both shoulders of a user, which permits the carrier to be slid over the body between at least two positions to facilitate, for example, the lifting of a pair of binoculars from a carry position at the front of the user's body up to the eyes of the user, which permits the carrier to be readily adjusted to carry articles of differing size, and, which permits the carrier to be used to form a loop which secures an article intermediate the loop and the body of the user.

Strap carrying systems are well known in the art. See, for example, U.S. Pat. No. 5,016,797 to Rowledge. The carrier system described in the Rowledge patent suffers from several disadvantages. First, the distance between vertical front straps 1 and 2 is fixed, so that the distance between snaps 13 cannot be adjusted to adapt the carrier to articles of differing size. Second, the carrier is not constructed so that the straps can be slid on the body to slidably vertically adjust the position of lateral strap 10 on the front of the user's body. This is why slides 15 are utilized. Slides 15 permit an article to be moved vertically over the front area of the user's body. Third, the carrier cannot be utilized as a simple U-shaped sling for carrying rifles or other larger articles. Fourth, the carrier cannot be utilized to form a loop which extends around an article to secure the article against the body of the user. Fifth, the carrier in the Rowledge patent requires that the carrying strap which extends around the body be stitched together, which increases manufacturing costs. Sixth, the carrier in the Rowledge patent requires the use of a disk 5 to secure overlapping strap portions together on the back area of the user. Disk 5 prevents strap 2 from sliding along strap 1 in a direction parallel to the longitudinal axis of strap 1 and, consequently, inhibits the freedom of movement necessary for the strap 10 to be readily slid vertically over the front area of a user.

Accordingly, it would be highly desirable to provide an improved article carrier which would not require stitching when being manufactured, which could be readily slid over the user's torso when worn, which could be adjusted to fit children or adults, which could be adjusted to carry articles of differing size, and which could be utilized either as a simple over-the-shoulder U-shaped sling or as a strap support system which could be extended around the torso and over both shoulders of the user to distribute over the user's body the weight of the article carried by the strap support system.

Therefore, it is a principal object of the invention to provide an improved article carrier.

Another object of the invention is to provide an article carrier which can be constructed by utilizing a single strap and a plurality of buckles slidably mounted on the strap such that the strap need not be stitched to itself or to the buckles.

A further object of the invention is to provide an article carrier which can be utilized as a U-shaped support strap extending over one shoulder of a user or which can be utilized as an article carrier which extends over both shoulders and around the torso of the user.

Still another object of the invention is to provide an article carrier which, when worn on the user, can be adapted to form a loop which extends around an article and secures the article against the body of the user.

Yet a further object of the invention is to provide an article carrier which can be slid up and down over both the chest and back of the user to facilitate the movement of an article suspended on the carrier between two positions, a storage position at the front area of the user and a deployed position near the head and face of the user.

These and other, further and more specific objects and advantages of the invention will be apparent to those skilled in the art from the following detailed description thereof, taken in conjunction with the drawings, in which:

FIG. 8 is a view of the front of a user illustrating an article carrier constructed in accordance with the invention and utilized to loop around an article to secure the article to the body of the user;

Briefly, in accordance with my invention, I provide an improved article carrier. The carrier includes a strap including first and second ends; first connector means for releasably retaining an article suspended from a front area of a user and including a first aperture means extending through the connector means for slidably receiving the first end of the strap in the front area of the user; second connector means spaced apart from the first connector means for releasably retaining the article suspended from the chest area of the user and including a second aperture means extending through the connector means for slidably receiving the second end in the front area of the user; first buckle means on the first end of the strap; and, second buckle means on the second end of the strap. The first end of the strap loops through the first aperture means and the first buckle means and the second end of the strap loops through the second aperture means and the second buckle means such that the first buckle means can be used to shorten and lengthen the first end of the strap, and the second buckle means can be used to shorten and lengthen the second end of the strap. The strap extends from the front area of the user upwardly over the user's right shoulder; downwardly across the back area of the user; around the left side of the user; across the front area of the user; around the right side of the user; upwardly across the back of the user; and downwardly over the user's left shoulder to the front area of the user. The article carrier also includes means for attaching a portion of the strap extending across the front area of the user to at least one of the pair comprising the first end of the strap and the first connector means; and, means for attaching a portion of the strap extending across the front area of the user to at least one of the pair comprising the second end of the strap and the second connector means.

Figure 1:
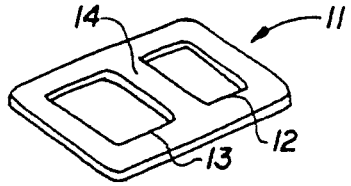
FIG. 1 is a perspective view illustrating a buckle utilized in an article carrier constructed in accordance with the invention.
Figure 2:
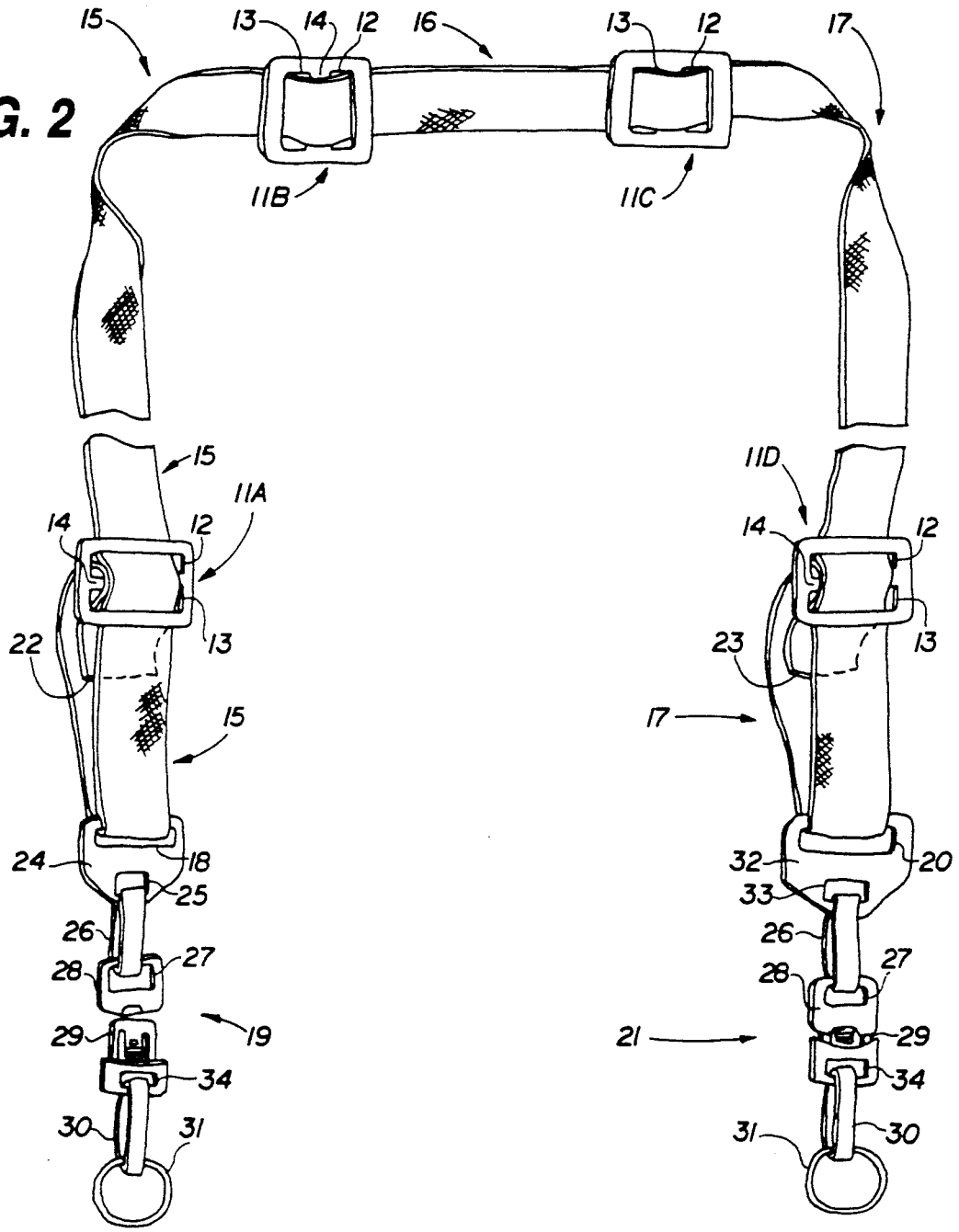
FIG. 2 is a top view illustrating a U-shaped article carrier constructed in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a buckle 11 of the type presently utilized in the practice of the invention and including cross-bar 14 and apertures 12 and 13 formed therethrough. In FIG. 2, buckles 11A, 11B, 11C, and 11D are each identical to buckle 11.

The U-shaped over-the-shoulder strap of FIG. 2 includes an elongate unitary strap which slidably extends through buckles 11A to 11D. The elongate unitary strap includes a first end 15 which extends from buckle 11B, through apertures 12 and 13 of buckle 11A, through aperture 18 of connector means 19, and from aperture 18 up to buckle 11A and back through apertures 12 and 13. The strap also includes a second end 17 which extends from buckle 11C, through apertures 12 and 13 of buckle 11D, through aperture 20 of connector means 21, and from aperture 20 up to buckle 11D and back through apertures 12 and 13. The strap also includes an intermediate portion 16 which spans from buckle 11B to buckle 11C. Accordingly, the strap extends continuously from tip 22 through buckle 11A, through aperture 18, back through buckle 11A, through buckle 11B, through buckle 11C, through buckle 11D, through aperture 20, and back through apertures 12 and 13 of buckle 11D to tip 23.

Connector means 19 includes flat panel member 24 with apertures 18 and 25 formed therethrough; pliable fabric loop 26; female buckle member 28 with aperture 27 formed therethrough; flexible finger 29 slidably releasably received by member 28; pliable fabric loop 30; and, metal split ring 31. Loop 26 extends through apertures 25 and 27. Loop 30 extends through ring 31 and aperture 34 formed in the male buckle member. Connector means 21 includes flat panel member 32 with apertures 20 and 33 formed therethrough; pliable fabric loop 26; female buckle member 28 with aperture 27 formed therethrough; flexible finger 29 slidably releasably received by member 28; pliable fabric loop 30; and, metal split ring 31. Loop 26 extends through apertures 33 and 27. Pliable fabric loop 30 extends through ring 31 and aperture 34 formed in the male buckle member.

In use, the shoulder strap of FIG. 2 is placed over a shoulder of the user with portion 16 contacting the shoulder. A rifle or other article can be attached to split rings 31. As would be appreciated by those of skill in the art, buckle 11D can be slid along the strap to shorten or lengthen end 17. Similarly, buckle 11A can be slid along the strap to shorten or lengthen end 15. Buckles 11B and 11C can each be slid along the strap toward or away from one another to shorten or lengthen intermediate portion 16. If desired, buckles 11B and 11C can be removed from the strap unless the strap is to be configured in the manner illustrated in FIG. 3. Any other conventional or other connector means can be utilized in place of or in combination with the connector means 19 and 21 to secure the ends 15, 17 of the strap to an article being carried by the strap. Further, if desired, in FIG. 3 the lower end of panel portion 32 can be fixedly secured to the upper edge of buckle 11B and loop 26 can be removed from aperture 33 and instead extend through aperture 27 and through one of apertures 12 and 13 of buckle 11B. When panel portion 32 is so attached to buckle 11B and loop 26 passes through buckle 11B, then loop 26 is permanently affixed to buckle 11B and cannot be removed in the manner that loop 26 can be removed from between the strap and buckle 11B in the article carrier illustrated in FIG. 3.

Figure 3:
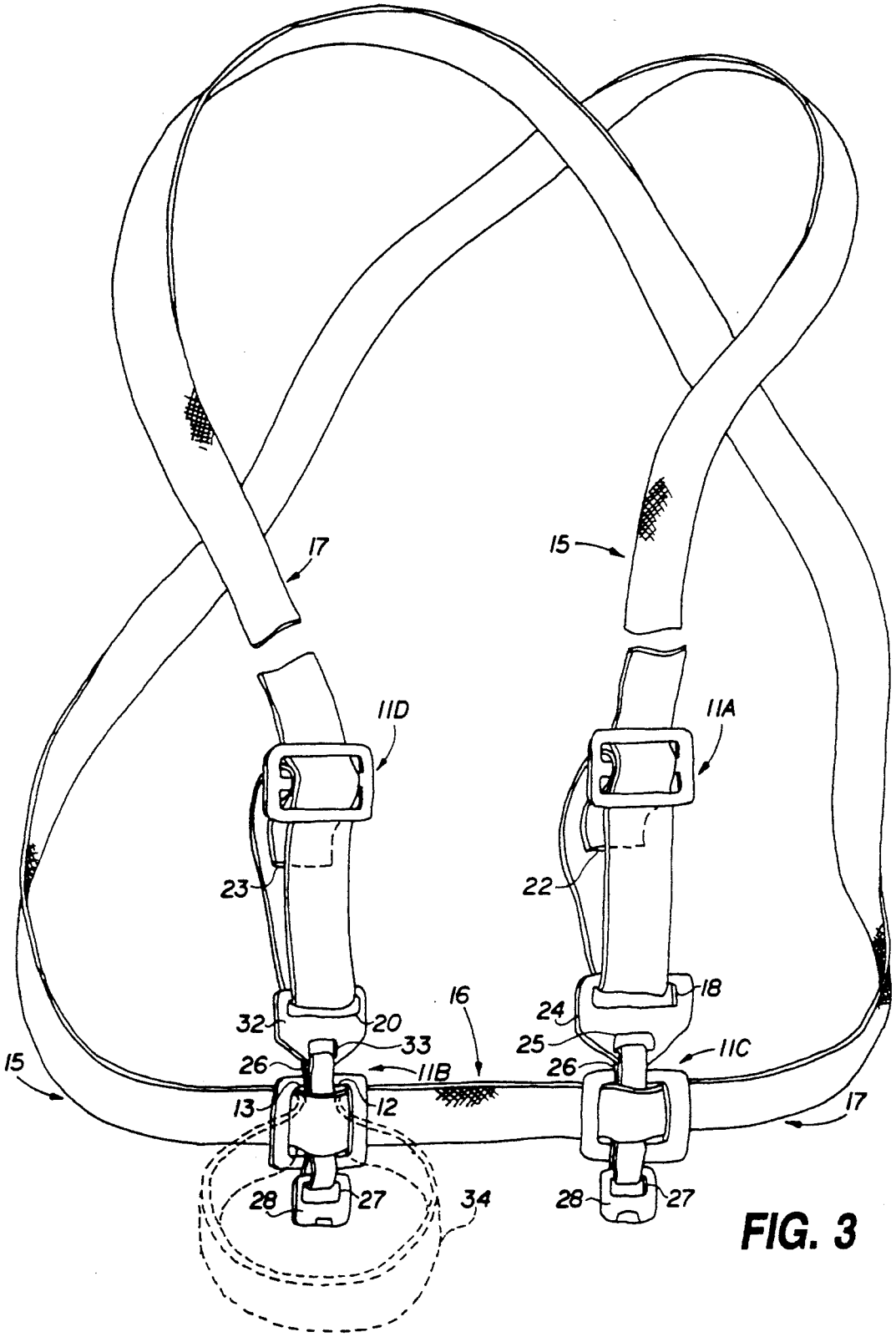
FIG. 3 is a top view illustrating the article carrier of FIG. 2 reconfigured to form an article carrier which extends over both shoulders and around the torso of a user.

The shoulder strap of FIG. 2 is configured in the manner illustrated in FIG. 3 by feeding the strap through apertures 12 and 13 of buckle 11B to form a loop indicated by dashed lines 34, by placing fabric loop 26 extending from aperture 33 over bar 14 (not visible in FIG. 3) of buckle 11B, and by drawing the loop 34 back through apertures 12 and 13 of buckle 11B to secure loop 26 in the position shown in FIG. 3. Loop 26 extending through aperture 25 is secured against bar 14 of buckle 11C in the position shown in FIG. 3 in a similar manner. In FIG. 3, buckles 11B and 11C can each be moved toward or away from one another by feeding the strap through an aperture 12 or 13 of buckle 11B or 11C in the manner indicated by the dashed lines 34 in FIG. 3 and by then pulling the strap through aperture 12 or 13 to move the buckle toward or away from the other buckle 11B or 11C. This procedure adjusts the distance between buckles 11B and 11C. Adjusting the distance between buckles 11B and 11C in FIG. 3 also adjusts the distance between connector means 19 and 21 since loops 26 move simultaneously with buckles 11B and 11C.

Figure 4:
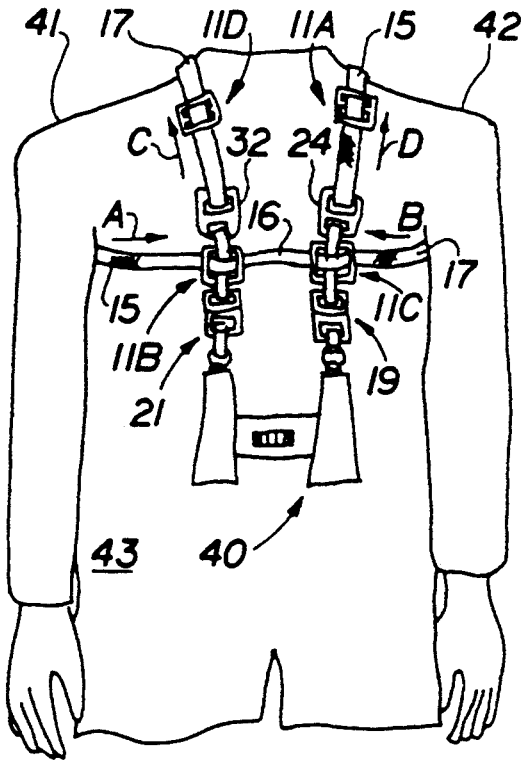
FIG. 4 is a view of the front of a user illustrating the article carrier of FIG. 3 on the user and supporting a pair of binoculars.
Figure 5:
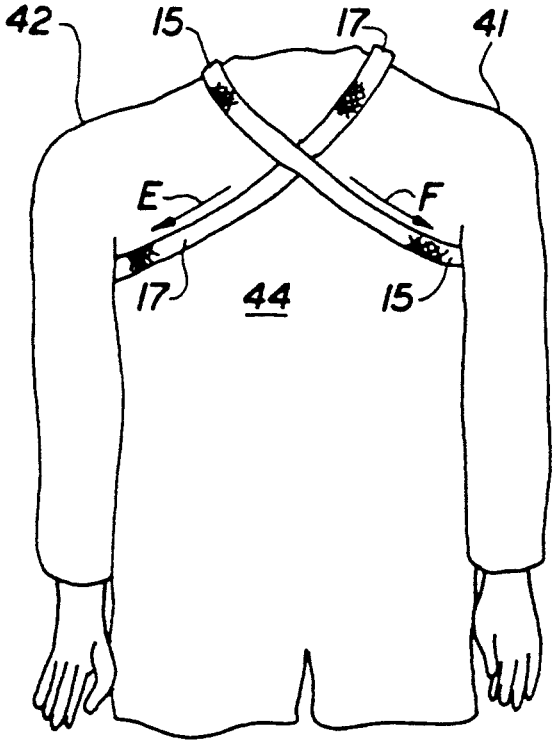
FIG. 5 is a view of the back of a user illustrating the article carrier of FIG. 3 on the user in the position also illustrated in FIG. 4.

The article carrier of FIG. 3 is illustrated on a user in FIGS. 4 and 5. End 17 extends over shoulder 41. End 15 extends over shoulder 42. Intermediate portion 16 and connector means 19 and 21 are positioned on the front area 43 of the user. In FIG. 5, ends 15 and 17 crisscross and overlap on the back area 44 of the user.

Figure 6:
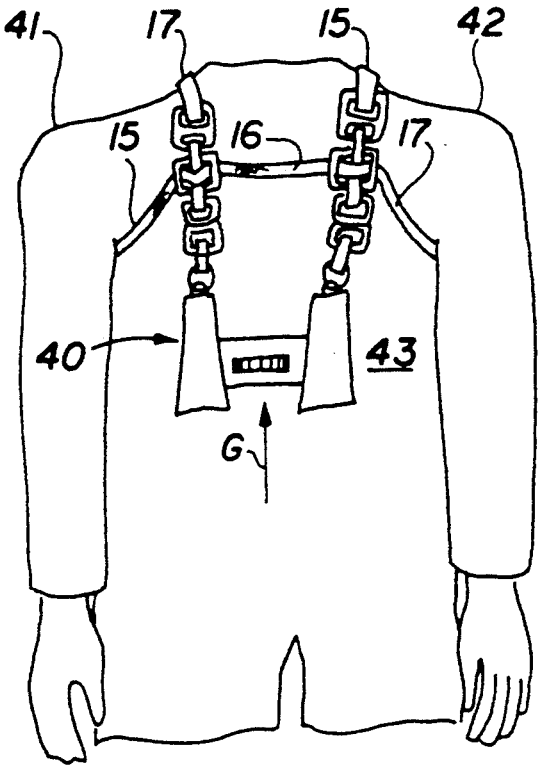
FIG. 6 is a view of the front of a user illustrating the article carrier of FIG. 3 after the article carrier has been slid over the body to upwardly displace the binoculars from the position shown in FIG. 4 to the position shown in FIG. 6.
Figure 7:
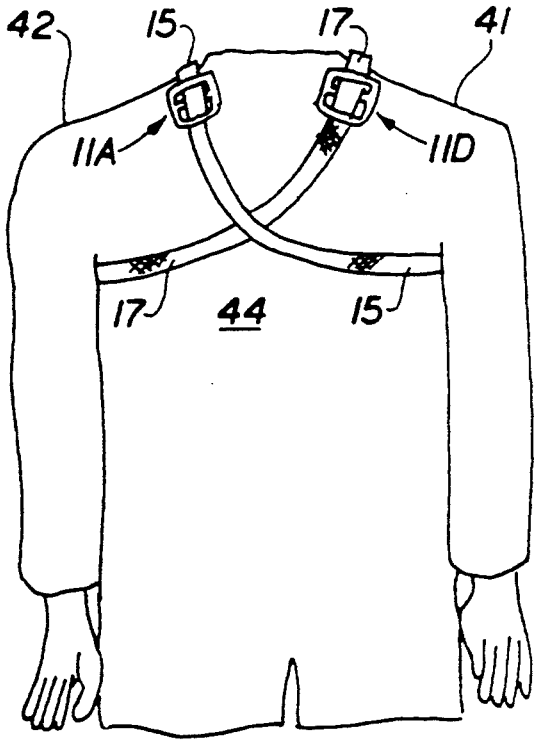
FIG. 7 is a view of the back of a user illustrating the article carrier of FIG. 3 on the user in the position also illustrated in FIG. 6.

FIGS. 6 and 7 illustrate the article carrier of FIGS. 4 and 5 after vertically oriented portions of the ends 17 and 15 have been slid upwardly over the front area 43 of the user in the direction of arrows C and D in FIG. 4 and downwardly over the back area of the user in the directions of arrows E and F in FIG. 5. When the vertically oriented portions or ends 17 and 15 are slid upwardly in the direction of arrows C and D, respectively, the horizontally oriented portions of ends 17 and 15 on the front area 43 of the user move upwardly in the directions indicated by arrows B and A in FIG. 4. When the article carrier of FIG. 3 is on the user in the orientation illustrated in FIGS. 6 and 7, the binoculars 40 are readily lifted up to the face and eyes of the user. In fact, the user can move the article carrier from the position illustrated in FIGS. 4 and 5 to the position illustrated in FIGS. 6 and 7 by manually grasping binoculars 40 and lifting the binocular to the user's eyes. Upwardly displacing the binoculars 40 to the eyes in such a manner upwardly pulls the connector means 19 and 21 and the article carrier such that the vertically oriented portions of straps 15 and 17 on the front area 43 of the user are displaced in the directions indicated by arrows D and C in FIG. 4 to the position illustrated in FIG. 6.

Important in the practice of the invention is the fact that ends 15 and 17 are not interconnected or held together at the point at which they overlap on the back area 44 of the user. Instead, ends 15 and 17 are free to move over one another vertically and horizontally when the article carrier is slid over the user's torso in the manner illustrated in FIGS. 4 and 6. In addition, the strap preferably, but not necessarily, utilized in the article carrier is a single unitary strap which does not have to be stitched to itself or to a buckle or other component of the article carrier.

In the embodiment of the invention illustrated in FIG. 8, the connector means 19 and 21 have been removed except for split rings 31 which interconnect ends 17 and 15 with binoculars 40. Rings 31 are of the type commonly used to hold keys. Such rings enable keys to be readily inserted on and removed from the rings. Also, in FIG. 8 buckles 11A and 11D are omitted for the sake of clarity. In FIG. 8, buckles 11B and 11C are on the front area 43 of the user at the same location as in FIG. 4. Buckles 11B and 11C are, however, not visible because the upper portions of binoculars 40 cover buckles 11B and 11C. Each loop 34 comprises a portion of the strap which, like the loop shown by dashed lines 34 in FIG. 3, extends through and outwardly from one aperture 12 in a buckles 11B, 11C and back to and through the other aperture 13 in the buckle 11B, 11C. Each loop 34 encircles and secures a portion of binoculars 40 against the chest of the user.

Figure 9:
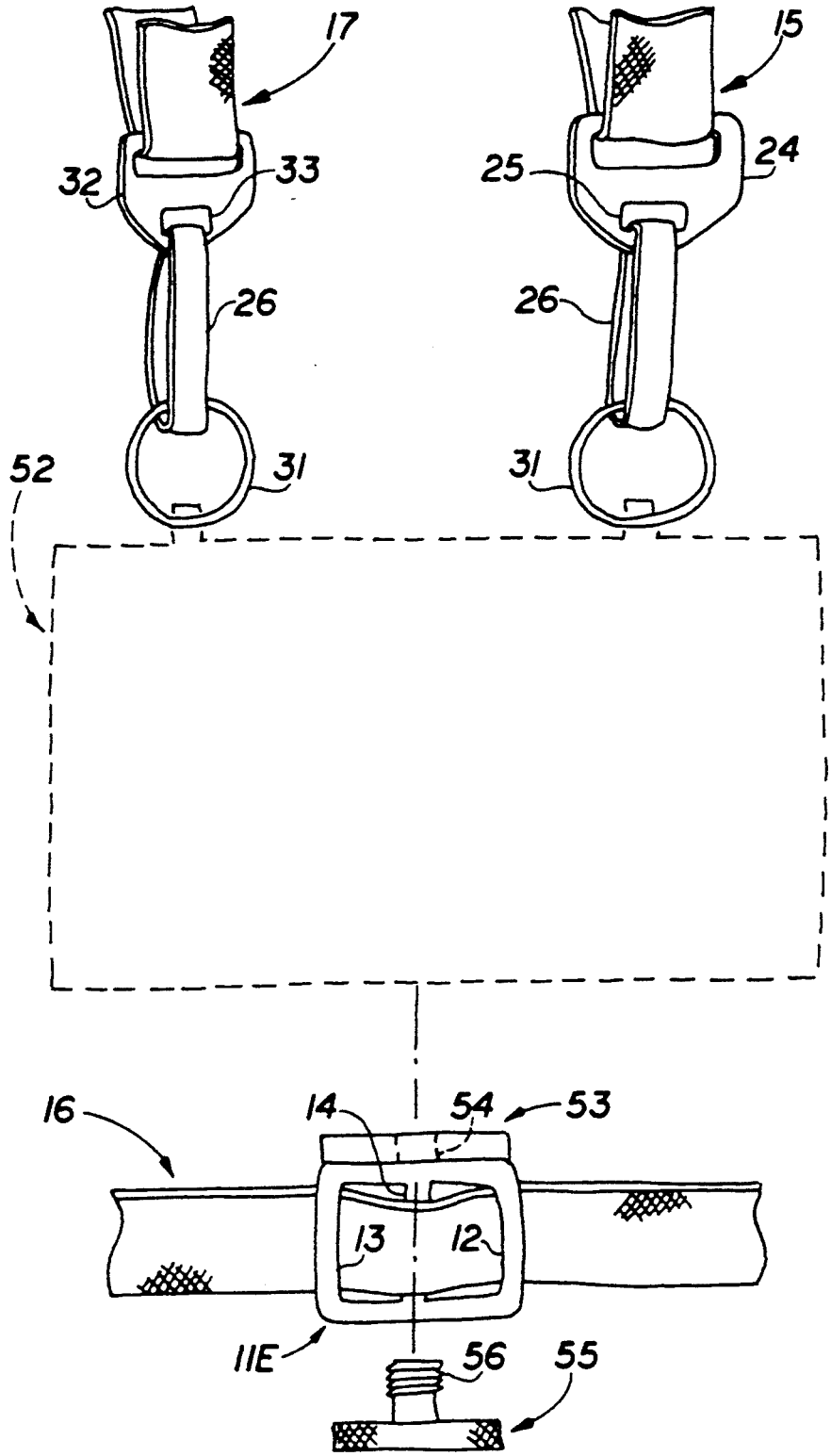
FIG. 9 is a front view illustrating an alternate embodiment of the invention; and, FIG. 10 is a perspective view illustrating a buckle bracket utilized in the embodiment of the invention of FIG. 9.

In the embodiment of the invention illustrated in FIGS. 9 and 10, the strap of FIG. 3 is utilized except that buckle members 28 and 29 and loops 30 have been removed, split rings 31 are attached directly to loops 26, loops 26 have been removed from contact with and positioned above buckles 11B and 11C, and an additional buckle—bracket 11E, 53 has been mounted on intermediate portion 16 of the strap. Buckles 11B and 11C are not visible in FIG. 9 but, as earlier described, bound portion 16 of the strap. Loops 26 are removed from contact with buckles 11B and 11C by feeding the strap through each buckle 11B and 11C to make a loop 34 and by then sliding loop 26 and the ring 31 on the loop 26 upwardly through and out of loop 34. After loop 26 is removed from loop 34, loop 34 is fed through the buckle 11B, 11C to flatten the strap against the buckle 11B, 11C to assume the orientation shown in FIG. 3.

Buckle 11E is identical in shape and dimension to buckle 11 of FIG. 1. Bracket 53 is fixedly attached to buckle 11E and includes an aperture 54 formed therethrough. The externally threaded end 56 of screw 55 extends through aperture 54 and turns into an internally threaded aperture (not visible) formed in the bottom of camera 52 or in the bottom of some other article suspended from split rings 31.

In use of the embodiment of the invention illustrated in FIG. 9, rings 31 are used to secure a camera or other article 52 to the ends 15, 17 of the strap. End 56 of screw 55 is passed upwardly through aperture 54 and threaded into an aperture formed in the bottom of camera 52 to secure camera 52 to buckle—bracket 11E, 53. Accordingly, rings 31 and screw 55 secure the camera 52 against the torso of the user intermediate the ends 15, 17 and the horizontally oriented intermediate portion 16 of the strap. When the camera 52 is secured between rings 31 and portion 16, camera 52 is readily moved from the torso of the user to a position in front of the user's eyes by simply its position on the torso of the user upwardly into position in front of the user's eyes. When the user so lifts the camera, the strap portions 15, 16, 17 slide over the user's body in the manner described in FIGS. 4 and 6. The strap "travels" over the user's body in a manner which permits the camera to be lifted from a position on the chest of the user to a position in front of the eyes of the user. As would be appreciated by those of skill in the art, fastening means other than buckle—bracket 11E, 53 can be used to secure camera 52 to strap 16. Fastening means other than rings 31, loops 26, and panel members 24, 32 can be used to secure the camera or other article 52 to ends 15, 17.

Having described my invention in such terms as to enable those skilled in the art to understand and practice it, and having identified the presently preferred embodiments thereof, I claim:

1. An article carrier for a person, comprising (a) a continuous elongate strap including (i) a first end (15) positioned at the front area of the person, (ii) a second end (17) positioned at the front area of the person, (iii) a first portion extending from said second end and from the front area of the person upwardly over the person's right shoulder, (iv) a second portion extending from said first portion downwardly across the back area of the person, (v) a third portion extending from said second portion around the left side of the person, (vi) a fourth portion extending from said third portion horizontally across the front area of the person and beneath said first and second ends, (vii) a fifth portion extending from said fourth portion around the right side of the person, (viii) a sixth portion extending from the fifth portion upwardly across the back of the person, and (ix) a seventh portion extending from the sixth portion downwardly over the person's left shoulder to the front area of the person and to said first end;

(b) first buckle means (11B) slidably mounted on said fourth portion of said strap beneath said second end and including a bar(14) interposed between first and second spaced apart apertures (12,13) such that said fourth portion loops through said first aperture (12); over said bar (14), and through said second aperture (13);

(c) second buckle means (11C) slidably mounted on said fourth portion of said strap beneath said first end and including a bar (14) interposed between first and second spaced apart apertures (12, 13) such that said fourth portion loops through said first aperture (12), over said bar (14), and through said second aperture (13);

(d) first support means (26) attached to and extending outwardly from said first end of said strap intermediate said fourth portion of said strap and said bar (14) of said first buckle means (11B) and having a distal end spaced apart from said first end of said strap and from said fourth portion of said strap;

(e) first connector means (28, 29, 30, 31) attached to said distal end of said first support means for releasably retaining an article suspended from the front area of the person;

(f) second support means (26) spaced a distance apart from said first support means and attached to and extending outwardly from said second end of said strap intermediate said fourth portion of said strap and said bar (14) of said second buckle means (11C) and having a distal end spaced apart from said second end of said strap and said fourth portion of said strap;

(g) second connection means (28, 29, 30, 31) attached to said distal end of said second support means for releasably retaining the article suspended from the front area of the person;

said distance between said first and second support means and said first and second connector means being adjustable by sliding said first and second buckle means along said fourth portion of said strap to move said first and second support means along said strap intermediate said fourth portion of said strap and said first and second buckle means, respectively;

said first and second connector means extending away from said distal ends of said first and second support means, respectively, extending away from said first and second buckle means, and extending away from said fourth portion of said strap;

said first support means contacting and passing intermediate said fourth portion of said strap and said bar (14) of said first buckle (11B); and said second support means contacting and passing intermediate said fourth portion of said strap and said bar (14) of said second buckle (11C).

* * * * *